US005775503A

United States Patent [19]

LeBras

[11] Patent Number: 5,775,503

[45] Date of Patent: Jul. 7, 1998

[54] ARTICLE CARRIER

[75] Inventor: Philippe LeBras, Chateauroux, France

[73] Assignee: The Mead Corporation, Dayton, Ohio

[21] Appl. No.: 809,381

[22] PCT Filed: Sep. 21, 1995

[86] PCT No.: PCT/US95/12063

§ 371 Date: Jun. 11, 1997

§ 102(e) Date: Jun. 11, 1997

[87] PCT Pub. No.: WO96/09226

PCT Pub. Date: Mar. 28, 1996

[30] Foreign Application Priority Data

Sep. 22, 1994 [GB] United Kingdom ..... 9419108

[51] Int. Cl.[6] ..... B65D 75/00

[52] U.S. Cl. ..... 206/427; 206/158; 53/398

[58] Field of Search ..... 206/147, 155, 206/158, 427, 429, 434; 53/398, 48.1

[56] References Cited

U.S. PATENT DOCUMENTS

| | | | |
|---|---|---|---|
| D. 271,749 | 12/1983 | Wood | D9/433 |
| D. 271,944 | 12/1983 | Wood | D9/416 |
| 2,764,284 | 9/1956 | Arneson | 206/147 |
| 3,016,259 | 1/1962 | Lawrence | 294/87.2 |
| 4,339,032 | 7/1982 | Wood | 206/158 |
| 4,372,599 | 2/1983 | Kiedaisch et al. | 294/87.2 |
| 4,378,879 | 4/1983 | Killy | 206/158 |
| 4,403,689 | 9/1983 | Wood | 206/158 |
| 4,936,455 | 6/1990 | Bienaime | 206/427 |
| 5,267,644 | 12/1993 | Tsao | 206/151 |

FOREIGN PATENT DOCUMENTS

| | | |
|---|---|---|
| 0 188 327 | 7/1986 | European Pat. Off. . |
| 2 238 285 | 5/1991 | United Kingdom . |

*Primary Examiner*—David T. Fidei
*Attorney, Agent, or Firm*—Michael V. Drew

[57] ABSTRACT

A blank for forming an article carrier of the top gripping type comprising hingeably interconnected first and second side panels, first and second end panels and upper panels having means for cooperating with an article to retain the article in a formed carrier, wherein the first end panel, first side panel, second end panel and second side panel are hingeably interconnected in series about an aperture through which an article is passable in packaging the article during formation of the carrier.

13 Claims, 3 Drawing Sheets

ARTICLE CARRIER

The invention relates to a carrier for articles such as bottles and more particularly to top gripping carriers which engage, for example, the underside of bottle caps thereby to retain the bottle within the carrier.

It is known to provide top gripping (or clipping) carriers for carrying two bottles of the PET soft drinks type. U.S. Pat. No. 4,403,689, U.S. Pat. No. 4,378,879, U.S. Pat. No. 4,339,032, U.S. Pat. No. Des. 271,944 and U.S. Pat. No. Des. 271,749 disclose article carriers of this type. For example, U.S. Pat. No. 4,339,032 discloses a blank for forming a bottomless bottle carrier wherein the crowns of the bottles are engaged in apertures located on a central fold line between adjacent upper panels of the carton and the sides of the blank are folded downwardly about the fold line prior to engaging the apertures with the underside of bottle tops passed therethrough.

The carton of U.S. Pat. No. 4,339,032 comprises side walls having upper portions just described with article receiving apertures. Additionally lower portions of the side walls are foldably attached to a series of panels which form side skirts in the carton. Ends of the skirts are glued to the inside of a lower portion of the opposite side panel to that to which the skirts are foldably attached. Also, an internal panel is provided which is foldably attached to the upper portions of the side walls but which rotates inwardly in forming the carton to provide an upper reinforcing panel. Therefore, the carton disclosed by Wood in U.S. Pat. No. 4,339,032 undergoes a series of folding operations and gluing operations in order to form a substantially complete carton prior to loading articles therein. When substantially formed, the carton is lowered onto a pair of bottles until the retaining apertures engage the caps of the bottle thus providing a bottomless carton having side and upper walls and end skirts.

The invention seeks to avoid or at least mitigate various problems of the prior art and according to one aspect of the invention there is provided a carton blank for forming an article carrier of the top gripping type comprising hingably interconnected first and second end panels, first and second side panels and an upper panel having means for cooperating with an article to retain the article in a formed carrier, wherein the first end panel, first side panel, second end panel and second side panel are hingably interconnected in series about an aperture through which an article is passable in packaging the article during formation of the carrier.

The first end panel can be hingably connected to said first side panel via a gusset panel. The gusset panel can be hingably attached to a fold panel which is hingably attached to said first side panel along a fold line, said fold panel enabling relative folding of the first end panel and first side panel during formation of the carrier. The first end panel and second side panel can be connected via a gusset panel and preferably a fold panel. The second end panel and first side panel can be connected via a gusset panel and preferably a fold panel, and the second end panel and second side panel can be foldably connected via a gusset panel and preferably a fold panel.

Preferably an inner panel can be hingably attached to the first side panel and extending into said aperture which inner panel comprises end edges for cooperating with associated end panels during the formation of the carrier. A second such inner panel can be hingably attached to the second side panel.

Another aspect of the invention provides a method of forming an article carrier of a top gripping type from a blank comprising hingably interconnected first and second end panels, first and second side panels and an upper panel having means for cooperating with an article to retain the article in a formed carrier, wherein the first end panel, first side panel, second end panel and second side panel are hingably interconnected in series about an aperture, the method comprising the steps of passing an article through the aperture, folding the side panels upwardly and engaging said article retaining means in said upper panel with the top of the article.

Where a gusset panel is hingably connected between each end panel and side panel of the blank and the method can further comprise the step of folding said end panels prior to folding said side panels upwardly.

If the blank further comprises a fold panel hingably connected between each gusset panel and associated side panel by fold lines, the method can comprise the step of folding the fold panel about a fold line connecting it to a side panel so as to cause folding of the associated end panel.

Where the blank further comprises an inner panel hingably connected to each side panel and extending into said aperture said inner panel comprising end edges for cooperating with associated end panels, the method can comprise the step of folding said inner panels upwardly prior to folding said fold panels thereby to enable said end edges to cooperate with the end panels during erection thereof. Preferably the blank is lowered onto the article which causes the upward movement of the inner panels.

A further aspect of the invention provides a blank for forming an article carrier of the top gripping type comprising lower panels including a first and second side panel and end panels for wrapping around the sides and ends of a packaged article and an upper panel hingably attached to said first side panel along a fold line, said upper panel comprising means for cooperating with the top of the article to retain the article in the formed carrier, wherein said retaining means is configurable to cooperate with the article top upon folding of the upper panel about said fold line.

A second upper panel can be hingably attached to said second side panel which panel also comprises article retaining means.

The retaining means can comprise an aperture defined by a rim which is at least partially in one of said upper panels. The rim can extend into the associated side panel across the associated fold line. Part of said aperture rim in said upper panel and said side panel can cooperate with the article top to retain the article in the carton.

A further aspect of the invention provides a method of forming an article carrier of the top gripping type from a blank comprising lower panels including a first and second side panel and end panels for wrapping around the sides and ends of a packaged article and an upper panel hingably attached to said first side panel along a fold line, said upper panel comprising means for cooperating with the top of the article to retain the article in the formed carrier, wherein said retaining means is configurable to cooperate with the article top upon folding of the upper panel about said fold line, the method comprising the step of forming the side and end panels around an article and folding the upper panel about said fold line into a position adjacent the second side panel thereby to bring said retaining means into cooperation with the article.

Where the blank comprises a second upper panel having article retaining means is hingably attached to said second side panel and the method can comprise the step of folding said second upper panel to a position adjacent said first side panel thereby to engage said retaining means with an article top. The step of attaching the second upper panel to the first side panel preferably by gluing can be included.

Beneficially any step of either aspects of the methods according to the invention can be combined in a method of making a carrier.

Beneficially any feature of either aspects of the blanks according to the invention can be combined in a blank. A handle in at least one of the side or upper panels can also be provided. Preferably the blank can be adapted to package a plurality of articles and having retaining means for each.

The invention will now be described by way of example only, with reference to the following drawings, in which.

Figure 1:
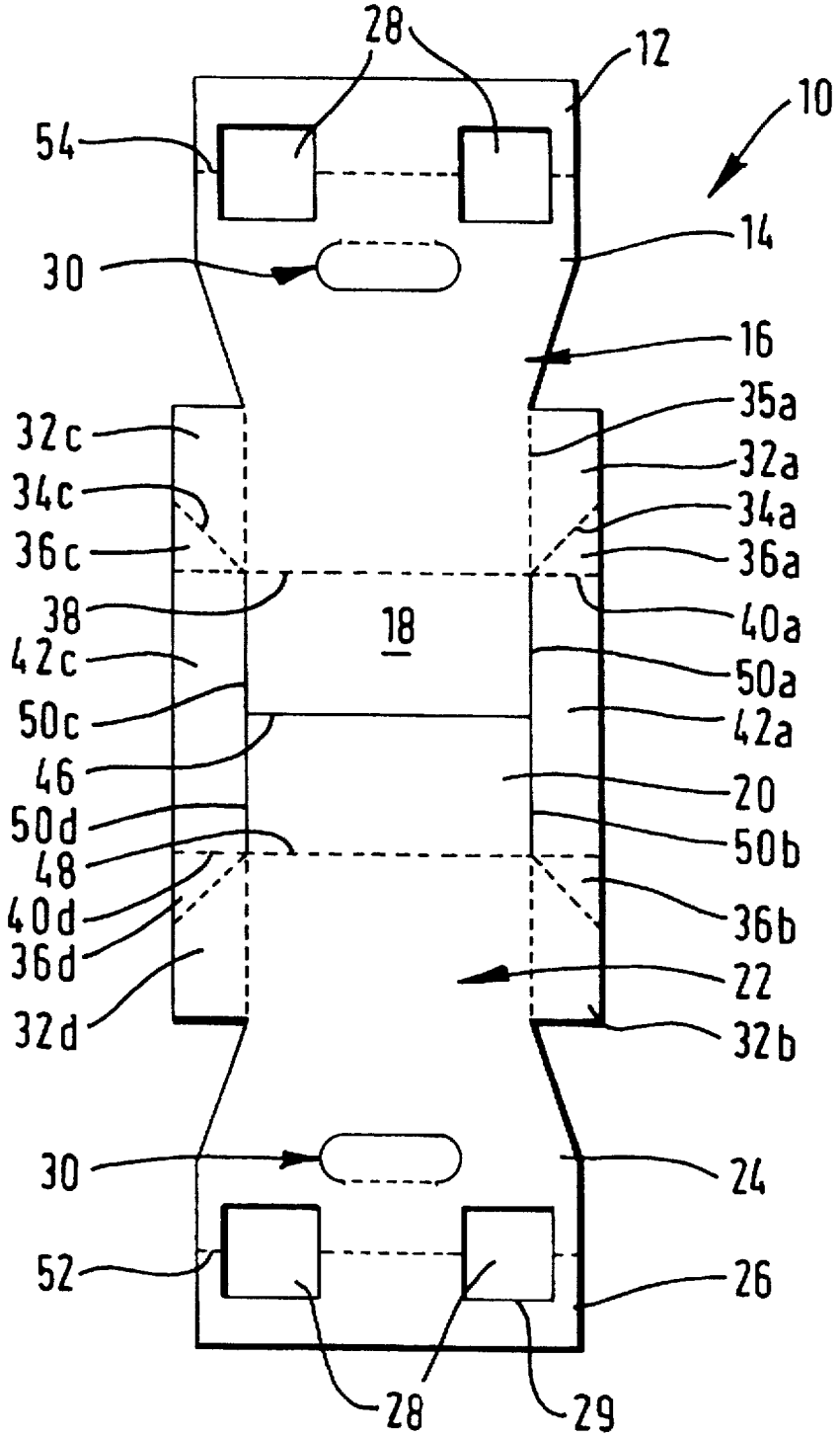
FIG. 1 is a plan view of a carrier blank according to the invention.

An example of a carrier blank 10 according to the invention comprises an upper panel 12 hingably connected to a side panel 16 along fold line 54. Bottle cap engaging apertures 28 are provided in the upper panels and can, as shown here, straddle the fold line 54 so as to extend into an upper side portion 14 of the side wall 16. Side panel 16 thus comprises an upper side portion 14 having, in this example, a handle 30 comprising a handle flap hingably connected to the upper side portion 14 thus defining a handle aperture. Side panel 16 is hingably connected at fold line 38 to an inner panel 18. Inner panel 18 is separated from a second inner panel 20 by cut line 46 which runs transversely across the middle of the carrier blank. Cut line 46 forms a mirror symmetry axis of the carrier.

A fold panel 32*a* is hingably connected to side panel 16 at fold line 35*a*. A triangular or gusset panel 36*a* is foldably connected along fold line 34*a* to fold panel 32*a*. The gusset panel 36*a* is foldably connected to an end panel 42*a* along a fold line 40*a*. Due to the symmetry of the carton similar fold and gusset panels are provided along each lateral edge of side panels 16 and 22 where like integers have the same reference numerals suffixed by the letter a, b, c or d. Thus four fold panels 32 and four gusset panels 36 are provided. Two end panels 42*a* and 42*c* extend between associated pairs of gusset panels. These end panels provide bands or skirts in the formed carrier which help secure the articles in the carrier. The inner panels 18 and 20 are separated by cut lines 50*a* and 50*c* from the end panels 42*a* and 42*c* respectively. The inner panels can therefore be displaced to reveal an aperture 60 defined by the edges of end panels 42*a* and 42*c* adjacent cut lines 50*a* and 50*c* respectively, and the edges of side panels 16 and 22 at fold lines 38 and 48 respectively.

The second inner panel 20 is hingably connected to a side panel 22 along fold line 48. Again, due to the symmetry of the carton, side panel 22 comprises an upper side portion 24 which comprises a handle 30 and bottle cap engaging apertures 28 which extend into upper panel 26. The upper panel 26 is hingably connected to side panel 22 along fold line 52.

Figure 2:
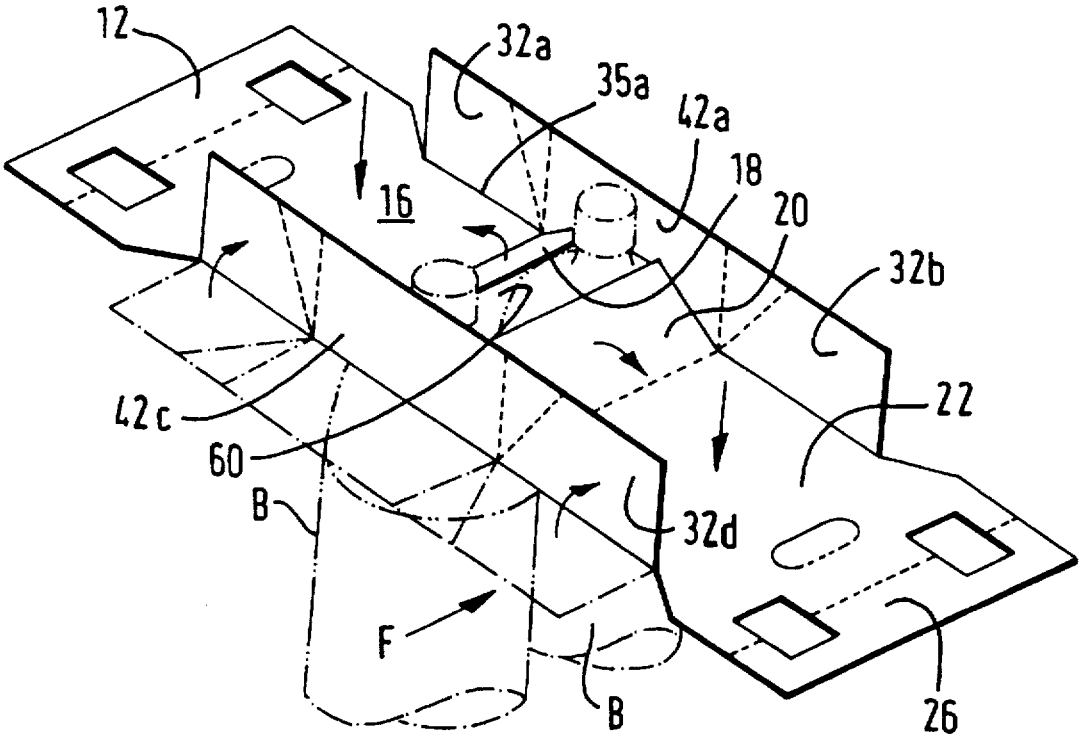
FIG. 2 is a perspective view of an initial stage of forming a carrier according to the invention from the blank shown in FIG. 1.
Figure 3:
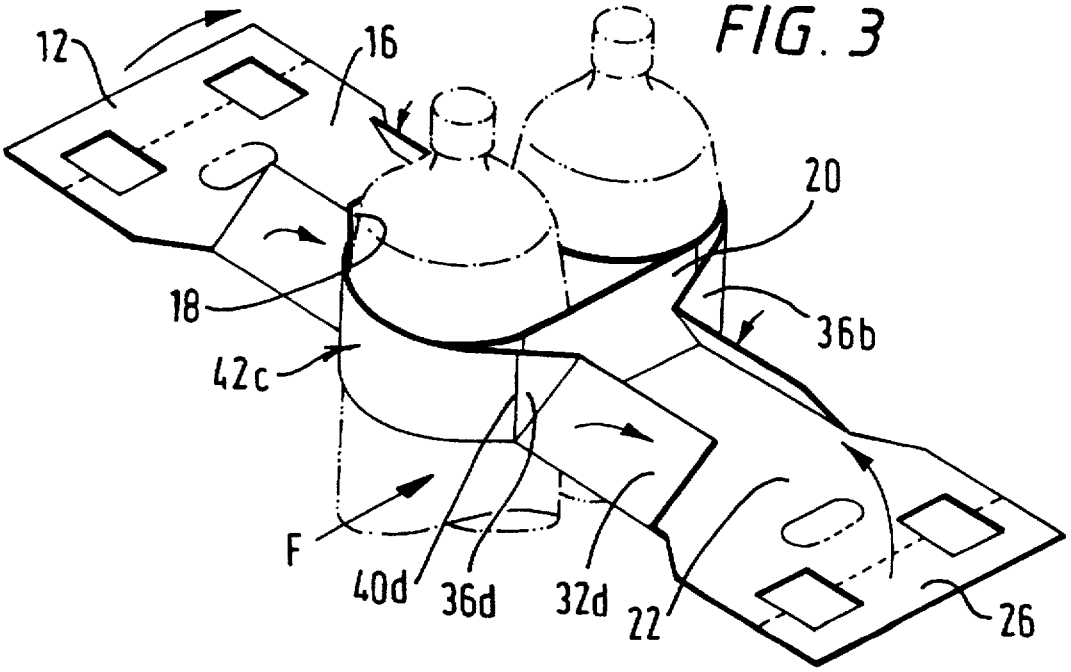
FIG. 3 shows a second stage of formation following that shown in FIG. 2.

As can be seen from FIG. 2, the carton blank here is used to package two bottles B. The carton blank can be first pushed down onto the tops of the bottles such that inner panels 18 and 20 are caused to fold upwardly about fold lines 38 and 48 respectively. The fold panels, gusset panels and end panels are then all folded upwardly about fold lines 35. Fold panels 32 are then folded downwardly against the inside of the side panels as shown in FIG. 3. This folding causes the gusset panels 36 to pull the end panels or bands 42 in tightly around the ends of the packaged articles B. Beneficially, the inner panels 18 and 20 can be provided to assist in the formation of the carrier during this folding process as end panels 42*a* and 42*c* grip the outside of the bottles and gusset panels 36 are caused to rotate inwardly. This assistance can be provided by cooperation between end edges of the inner panel and the gusset panels, for example, by providing a reactive force adjacent fold lines 40 to enable folding of the gusset panels 36 and tightening of the end panels 42 during rotation of fold panels 32. Beneficially, the end panel or band panel 42 can be used to carry advertising and/or to conceal a bar code on the primary packaging of the article being packaged.

Figure 4:
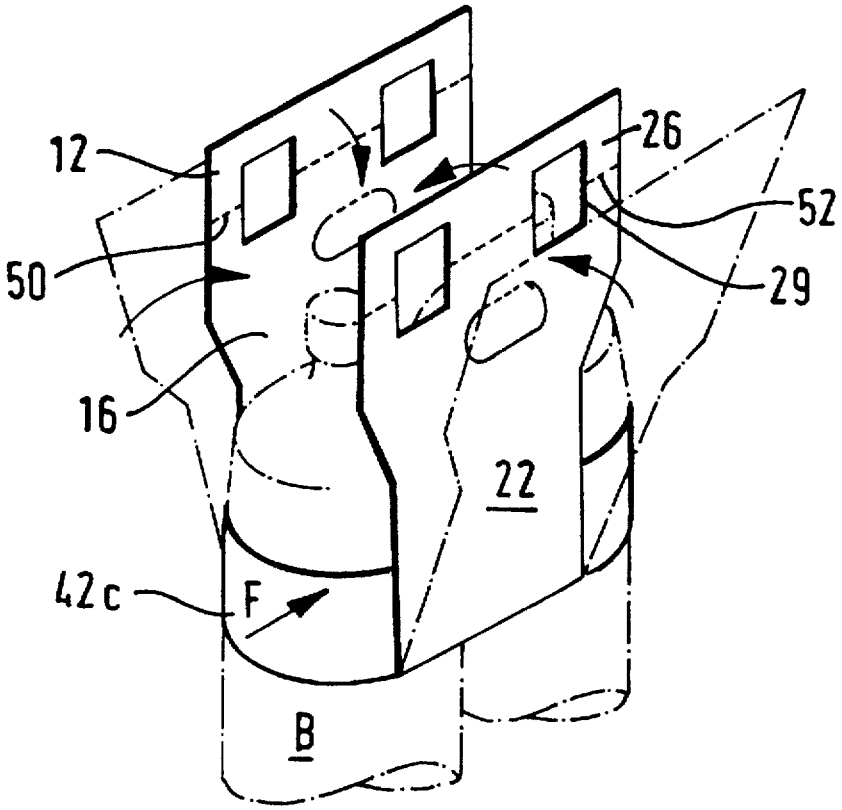
FIG. 4 shows a third stage of formation to that shown in FIGS. 2 and 3.
Figure 5:
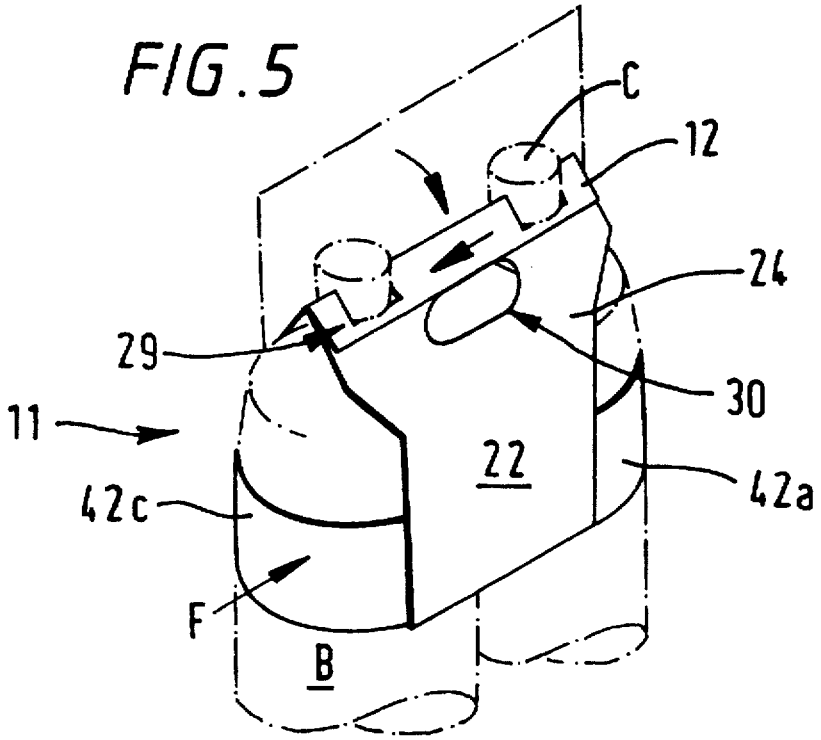
FIG. 5 is a perspective view of a completed carton according to the invention.

The side panels 16 and 22 can then be rotated upwardly as shown in FIG. 4 prior to folding upper panels 12 and 26 about respective fold lines 50 and 52 thereby to clip a bottle cap C of the articles to be carried in an aperture 28. As shown, upper panel 26 can first be folded over the bottle caps followed by upper panel 12 such that rims 29 of the bottle cap receiving apertures 28 grip the underside of a bottle cap C. During this folding process, upper side portions 14 and 24 are caused to fold inwardly contouring the shoulder portion of the bottles. To ensure that the carrier is secure upper panels 12 and/or 16 can be glued to one another or other securing means such as cooperating locking tabs and apertures might be provided. For example, glue could be applied to the inside of upper panel 12 prior to folding it into position, thereby to lock panel 12 against the outside of upper side portion 24. In the formed carton 11 shown in FIG. 5, a handle 30 can be presented near the top of the carton. The handle can comprise finger tabs as discussed earlier.

Means for cooperating with the top of the package articles B for retention other than the apertures 28 shown herein may be used. For example, a "starburst" type aperture may be provided as shown in EP 0 188 327 A2. Alternately, retention tabs of the type shown in GB 2 273 284 A may be used. Other possibilities will be recognized by those skilled in the art.

It will be appreciated from the foregoing discussion, that the carton is easily formed in a relatively simple folding operation and does not require any gluing or other adhesion of panels prior to attaching to articles. Thus, articles can be packaged using uniformed carriers in the form of a flat blank which can be folded into a carrier in cooperation with the articles whilst they move along a flow path as indicated by arrow F.

I claim:

1. A blank for forming an article carrier of the top gripping type comprising hingably interconnected first and second end panels, first and second side panels and an upper panel having means for cooperating with an article to retain the article in a formed carrier, wherein the first end panel, first side panel, second end panel and second side panel are hingably interconnected in series about an aperture through which an article is passable in packaging the article during formation of the carrier.

2. A blank according to claim 1 wherein at least one of said first and second end panels is hingably connected to at least one of said first and second side panels via a gusset structure.

3. A blank according to claim 2 wherein said gusset structure includes a gusset panel hingably attached to said at least one of said first and second end panels and to a fold panel which is hingably attached to said at least one of said first and second side panels along a fold line, said fold panel enabling relative folding of said at least one of said first and second end panels and said at least one of said first and second side panels during formation of the carrier.

4. A blank according to claim 1 further comprising an inner panel hingably attached to said first side panel and extending into said aperture which inner panel comprises end edges for cooperating with associated end panels during the formation of the carrier.

5. A blank according to claim 4 comprising a second such inner panel hingably attached to said second side panel.

6. A blank for forming an article carrier of the top gripping type comprising lower panels including a first and second side panel and end panels for wrapping around the sides and ends of a packaged article and at least one upper panel hingably attached to one of said first side panel and said second side panel, respectively, along a fold line, said at least one upper panel having retaining means including an aperture defining an aperture rim extending into said at least one upper panel across said fold line, wherein part of said aperture rim and said side panel cooperate with the article top upon folding of said at least one said upper panel about said fold line to retain the article in the carrier.

7. A method of forming an article carrier of a top gripping type from a blank comprising hingably interconnected first and second end panels, first and second side panels and an upper panel having means for cooperating with an article to retain the article in a formed carrier, wherein the first end panel, first side panel, second end panel and second side panel are hingably interconnected in series about an aperture, the method comprising the steps of passing an article through the aperture, folding the side panels upwardly and engaging said article retaining means in said upper panel with the top of the article.

8. A method according to claim 7 wherein a gusset panel is hingably connected between each end panel and side panel of the blank and the method further comprises the step of folding said end panels prior to folding said side panels upwardly.

9. A method according to claim 8 wherein said blank further comprises a fold panel hingably connected between each gusset panel and associated side panel by fold lines, the method comprising the step of folding the fold panel about one of said fold lines connecting it to a side panel so as to cause folding of the associated end panel.

10. A method according to claim 9 wherein the blank further comprises an inner panel hingably connected to each side panel and extending into said aperture said inner panel comprising end edges for cooperating with associated end panels, the method comprising the step of folding said inner panels upwardly prior to folding said fold panels thereby to enable said end edges to cooperate with the end panels during erection thereof.

11. A method according to claim 10 wherein the blank is lowered onto the article which causes the upward movement of said inner panels.

12. A blank for forming an article carrier of the top gripping type comprising lower panels including a first and second side panel and end panels for wrapping around the sides and ends of a packaged article and a first upper panel hingably attached to said first side panel along a first fold line and a second upper panel hingably attached to said second side panel along a second fold line, each of said first and second upper panels having retaining means including an aperture defining an aperture rim extending into a respective one of said first upper panel and said second upper panel across the respective said fold line thereof to cooperate with the article top upon folding of said upper panel about said fold line to retain the article in the formed carrier.

13. A blank according to claim 12, wherein part of said aperture rim in each of said upper panel and said lower panel and the associated said side panel thereof cooperates with the article top to retain the article in the carrier.

* * * * *